United States Patent [19]

Swiatosz

[11] Patent Number: 4,934,927

[45] Date of Patent: Jun. 19, 1990

[54] PERFORATED FLAME DEFLECTOR

[75] Inventor: Edmund Swiatosz, Maitland, Fla.

[73] Assignee: The United States of America as represented by the Secretary of the Navy, Washington, D.C.

[21] Appl. No.: 374,205

[22] Filed: Jun. 22, 1989

[51] Int. Cl.[5] ..... F23M 9/06

[52] U.S. Cl. ..... 431/171; 431/326; 431/347; 431/170

[58] Field of Search ..... 126/92 B; 431/114, 171, 431/347, 348, 350, 170, 100, 328; 239/498, 500; 110/322, 323, 326

[56] References Cited

U.S. PATENT DOCUMENTS

| | | | |
|---|---|---|---|
| 2,721,607 | 10/1955 | Damon et al. | 431/171 X |
| 3,312,269 | 4/1967 | Johnson | 431/347 X |
| 3,915,623 | 10/1975 | Wormser | 431/347 |
| 4,134,719 | 1/1979 | Velie | 431/171 |
| 4,264,298 | 4/1981 | Simeoni | 431/347 |
| 4,421,474 | 12/1983 | Meyer | 431/115 |
| 4,439,134 | 3/1984 | Olsson | 431/1 |
| 4,480,988 | 11/1984 | Okabayashi et al. | 431/329 |
| 4,538,530 | 9/1985 | Whitman | 110/260 |

*Primary Examiner*—Carl D. Price
*Attorney, Agent, or Firm*—Robert W. Adams

[57] ABSTRACT

A series of perforated plates are placed in alignment with a horizontally disposed burner tube and canted to spread the flame from the burner both axially and transverse the axis of the tube. Each perforation is accompanied by an upper scoop that extends downward and toward the tube to direct some of the upward flowing flame through the perforation. Thereby, the flame is spread in both length and width to cover a larger grating surface above the tube.

7 Claims, 1 Drawing Sheet

PERFORATED FLAME DEFLECTOR

BACKGROUND OF THE INVENTION

The invention relates to the field of gas burners, and more specifically, is an accessory for use with such burners to distribute the flame over an enhanced surface area. The present invention was originated for use with the propane burners of the Navy's fire fighting trainers, but has application wherever it is desirable to spread the flames from a gas burner over a larger area such as a grating surface.

The flames from gas burners tend to columnate, which tendency reduces the effectiveness of the burners for some applications. For example, an increased flame area is needed if food is to be cooked uniformly on a large grill, whereas relatively narrow columns of flame will generate hot spots. Accordingly, low pressure gas grills that are used for cooking often employ burners that are metal conduits running laterally to distribute the fuel more evenly under the grill area, and having upward opening holes whereat the gas and air are ignited to form the flames for cooking. Therein, the solution to more evenly distribute the heat for cooking is to distribute the fuel and generate more sources of flame. But, in the application for which the invention originally was intended, the burners are high volume, high pressure systems. The flames from the burners are intended to simulate comparatively massive fires onboard ship. The flames often are expected to represent a fire that is engulfing substantial floor space and large pieces of equipment and machinery. The advantages of the present invention as the solution to distribute the flame are more highly valued where the manifold systems available to distribute the fuel for low pressure/-low volume burners, are inappropriate.

U.S. Pat. No. 4,264,298 to Giuseppe Simeoni for Hotplate-Type Gas Burner, is representative of a manifold-type, flame dispersive structures that, in addition, includes a hotplate platter having an underside that is sloped upward and away from the burner to further elongate the spread of the flame. U.S. Pat. No. 4,134,719 to Wallace W. Velie for Multi-Flame Fuel Burner For Liquid And Gaseous Fuels, is representative of the traditional method employed with a burner to spread its flame, wherein a cap is placed in the path of the flame forcing it to spread to the perimeter of the cap in order to proceed upward. Both types of structure fail to achieve a substantially uniform flame over an enhanced surface area, and are incompatible with the high pressure, high volume burners used in fire fighting trainers and other devices.

A purpose of the present invention is to satisfy a heretofore unfulfilled need for a means to engulf a large surface area with the flame from a high capacity burner. Further, a purpose is to provide a means to enhance the spread of a flame from a burner that is an alternative to previously available means.

SUMMARY OF THE INVENTION

The invention is one or more perforated plates positioned in-line with the flame from a burner and oriented both to defect a portion of the flame and to pass a portion of the flame or deflected flame through the aperture(s). A baffle accompanies at least one of the apertures to assist in directing the flame to the far side of the plate. If multiple plates are used, they are spaced apart so that some of the flame that passes through the initial plate may reach the succeeding plate whereat the flame likewise is deflected and passed, preferably with the assistance of at least one baffle/aperture combination. The use of multiple plates will be necessary to achieve maximum distribution of the flame, depending on the burner's capacity and pressure.

The baffle protrudes to the near-side of the plate to capture deflected portions of the flame and direct them through the aperture, and may be constructed to protrude to the far-side of the plate in addition or as an alternative. Where the burner is oriented horizontally, the flame may be spread better by employing baffles only on apertures that are not within the column of flame as it impacts, the plate, inasmuch as a baffle might obstruct the direct passage of some of the flame through the aperture, and orienting the baffles where they are used to face radially inward toward the deflected flame as a scoop to most effectively direct the captured flame through the aperture to the far-side of the plate. Where the burner oriented vertically, the flame may be spread better by employing baffles on the far-side of the plate near the column of flame in order to deflect and spread the flame after it passes through the aperture, and to employ baffles on the near-side of the plate with or without baffles on the far-side for apertures more remote from the column of flame that is rising out of the burner.

DESCRIPTION OF A PREFERRED EMBODIMENT

Figure 1:
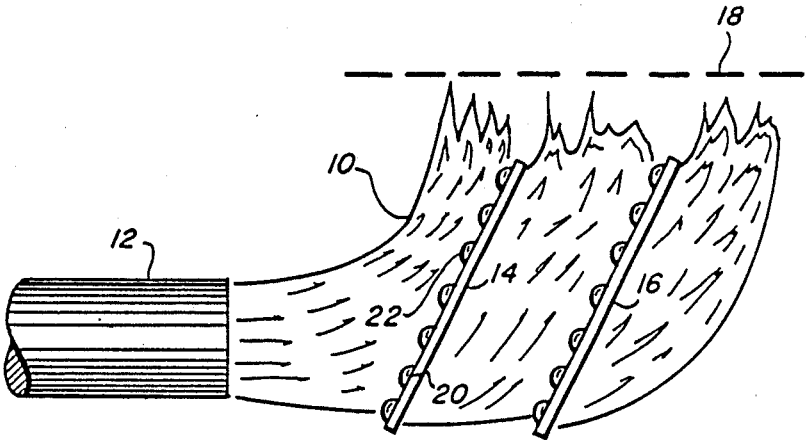
FIG. 1 shows a plan layout of the major components of the invention in an embodiment with a horizontally oriented burner.

FIG. 1 shows the preferred embodiment of the invention configured in its original design for use with a horizontal burner. Flame 10 is provided by tube 12 with force and volume. Without plates 14 and 16 the flame would form a vertical column and cover only a relatively small surface area of grate 18. However, the surface area of coverage is enhanced by providing apertures 20 in the plate(s) for communicating some of the flame longitudinally to the far side of the plate. Further, a portion of the flame also is directed through the aperture(s) by baffle(s) 22.

Plates 14 and 16 are resistant to flame damage. They may be made of any heat resistant material that can be formed, shaped, drilled or otherwise worked to provide apertures 20 and baffles 22. Suitable materials might include ceramic and selected grades of steel. The number of plates to be used and their respective tilt(s) as shown in FIG. 1 is determined through experimentation in the intended environment. Additional plates will provide further longitudinal spread to the flame, up to a limit dependent on the characteristics of flame 10 which in turn is dependent on the characteristics of the burner, such as its volume and force. The tilts of the plates to the flame may be parallel to one another as shown in FIG. 1, or may differ, and can be optimized through experimentation for the application. Further, the alignment of the plates in the path of the axis of tube 12 may be modified by moving each plate independently up, down, and to either side, to vary the flame's surface coverage at grate 18. The plates may be mounted in any convenient manner, a simple version of which is to attach the plates to a rod fixed to the underside of tube 12 and extending forward thereof.

Figure 2:
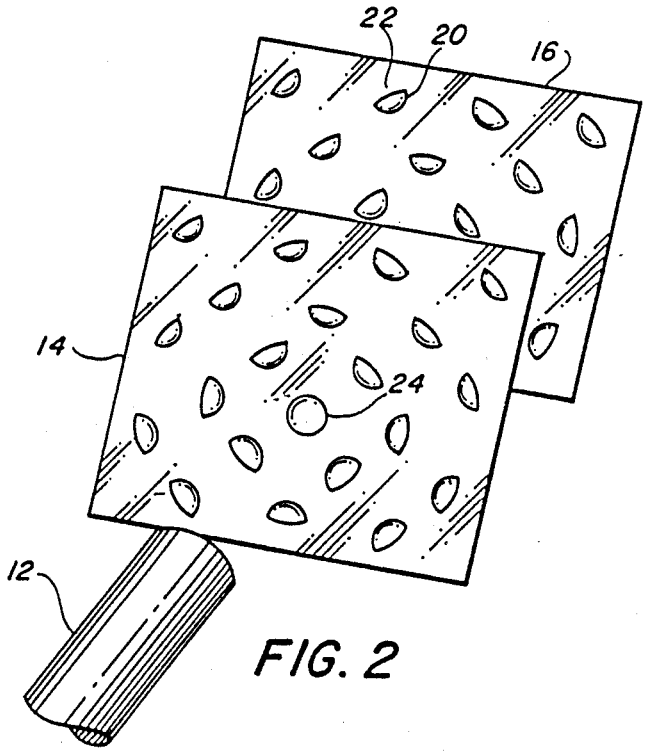
FIG. 2 shows a perspective view of the embodiment of FIG. 1.

FIG. 2 displays a representative pattern of apertures. Note that in the pattern, baffles 22 are oriented to scoop flame 10 as it spreads radially and upward from the axis of tube 12. The flame is diverted by baffles 22 through apertures 20 to the far side of plate 14 and plate 16. With respect to aperture 24 which is near or in alignment with the axis of tube 12 and therefore is within the point of impact of flame 10 on plate 14; the aperture is shown to be without a baffle. That is to demonstrate that some or all apertures on the plate(s) that are in direct line with flame 10 before it is diverted or otherwise deviates from a substantially axial direction with tube 12, may be fully open without a covering baffle or substantially uncovered by having a relatively small baffle. Only one aperture and baffle are identified by numbers on the figure for simplicity, although the apertures and baffles may be similar or identical on the plate and on each plate. Experimentation may be used to determine the preferred size(s), shape(s) and pattern(s) of apertures/baffles. The baffles may be oriented in any manner to achieve the desired effect, which for the present invention is to divert a significant portion of the flame to the far side of the plate. Since flame 10 is naturally deflected somewhat radially from the point of impact on plate 14, and since the plates are tilted in accordance with the invention to deflect the flame somewhat upward, and since the flame tends to rise of its own accord, it may be desirable to observe the flame in conjunction with the plates and experiment with the orientation of the baffle for individual apertures in order to achieve the preffered effect. Further, it may be desirable to position the point of impact of the flame onto the lower part of the plate, as shown in FIG. 1 and FIG. 2. Thereby, the plate would be positioned for flame 10 to interact with the greatest number of available apertures 20 as it predominantly tended to rise and spread.

Figure 3:
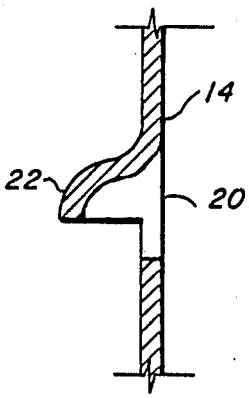
FIG. 3 shows a close-up view of an aperture and its associated baffle in the form of a scoop on the near-side of the deflection plate for directing a portion of the flame through the aperture to the far-side of the plate.

FIG. 3 shows a closeup cutaway view of a representative aperture 20 and baffle 22 in plate 14. Baffle 22 opens downward in the figure to receive flame rising upward. Also, the baffle is shown to be in substantial, but not complete, covering relationship to aperture 20 which indicates that the aperture is not within the point of contact of the flame eminating from tube 12, and probably is not at the extreme edge of the plate whereat the baffle would be expected to be in complete covering relationship to its aperture. Baffle 22 is shown in the shape of an elongated-S, which is preferred. Alternative shapes may include a lineal slope. Consideration is given to the shape and size of the aperture when the shape and size for the baffle is being selected. Aperture 20 is shown to be substantially circular, which is preferred. Alternative shapes may include rectangular, such as upright rectangular in conjunction with a long, narrow baffle, and slotted rectangular in conjunction with a short, wide baffle. For substantially circular aperture 20 and elongated-S baffle 22, the baffle may be cut and pressed from the plate. Other shapes such as a flat, lineally sloped scoop with solid sides, may require attachment by welding or the like of baffles that have been prepared separately.

From the foregoing description, it readily may be seen that the present invention comprises a new, unique, and exceedingly useful flame spreader which constitutes a considerable improvement over the known prior art. Obviously, many modifications and variations of the present invention are possible in light of the above teachings. It is, therefore, to be understood that within the scope of the appended claims the present invention may be practiced otherwise than as specifically described.

What is claimed is:

1. Apparatus for use in conjunction with a burner tube to enhance the spread of the flame that emanates from the exit end of the tube so as to envelope a larger surface area with flames, comprising:

substantially flat plate means distance from the burner, and positioned within the flame downstream the exit end of the tube and angular to the longitudinal axis of the tube, for diverting the direction of propagation of the flame upwardly off the surface of the plate means; and, means for enhancing the spread of the flame, including means within said plate means having a plurality of apertures for communicating some of said flame longitudinally beyond the plate means, and deflection means having baffles protruding from the surface of the plate means toward the tube in partial covering relationship to some of the apertures for receiving some of said diverted flame and redirecting it to said aperture means;

such that an area above the burner that is covered by flame consists of the area attributable to the portion of the flame that is diverted upward by the plate means, enhanced by the area attributable to the portion of the flame communicated beyond the plate means by the aperture means.

2. The apparatus of claim 1 wherein said tube is oriented horizontally, and said plate means oriented diagonal to the axis of said tube with an edge of the plate means being more remote from the tube than the lower edge of the plate means.

3. The apparatus of claim 2 wherein each baffle has a respective aperture and each baffle joins said plate means near the uppermost portion of its aperture and angles downwardly and away from said surface to the baffle's lowest point which is most remote from the surface, such that the flame is made to spread longitudinally.

4. The apparatus of claim 3 wherein said baffle is cupped, with its concave side facing downward.

5. The apparatus of claim 2 wherein each baffle has a respective aperture and each baffle joins said plate means near the outermost portion of its aperture and angles away from said surface toward said tube whereat the proximate part of the baffle is most remote from the surface, such that the flame is made to spread radially.

6. The apparatus of claim 5 wherein said baffle is cupped, with its concave side facing radially inward.

7. The apparatus of claim 2 wherein said plate means comprises a plurality of said plates, each spaced apart from the other with the first being nearest said tube and the last being most remote from the tube, such that a portion of the flame that is deflected through the apertures of the first plate may encounter the next plate, and so on through the last plate.

* * * * *